United States Patent [19]

Granger et al.

[11] Patent Number: 4,540,046

[45] Date of Patent: Sep. 10, 1985

[54] SHEAR RAM APPARATUS

[75] Inventors: Stanley W. Granger, Diamond Bar; James J. Camerano, Rowland Heights, both of Calif.

[73] Assignee: NL Industries, Inc., New York, N.Y.

[21] Appl. No.: 531,928

[22] Filed: Sep. 13, 1983

[51] Int. Cl.[3] ..... E21B 29/00

[52] U.S. Cl. ..... 166/55; 277/12; 277/30; 277/129; 83/694

[58] Field of Search ..... 166/55, 55.1; 251/1 R, 251/1 A, 1 B; 277/30-32, 12, 129; 83/694, 698; 72/464; 30/92; 137/242

[56] References Cited

U.S. PATENT DOCUMENTS

| | | | |
|---|---|---|---|
| 2,398,840 | 4/1946 | Morin | 83/694 |
| 2,919,111 | 12/1959 | Nicolson | 166/55 |
| 3,434,729 | 3/1969 | Shaffer et al. | 251/1 A |
| 3,590,920 | 7/1971 | Orund et al. | 166/55 |
| 3,736,982 | 6/1973 | Vujasinovic | 166/55 |
| 3,766,978 | 10/1973 | Orund et al. | 166/55 |
| 3,880,436 | 4/1975 | Canal | 277/126 |
| 3,915,426 | 10/1975 | LeRouax | 251/1 B |
| 4,081,027 | 3/1978 | Nguyen | 166/55 |
| 4,132,266 | 1/1979 | Randall | 166/55 |
| 4,132,267 | 1/1979 | Jones | 166/55 |
| 4,313,496 | 2/1982 | Childs et al. | 166/55 |
| 4,341,264 | 7/1982 | Cox et al. | 166/55 |
| 4,347,898 | 9/1982 | Jones | 166/55 |

FOREIGN PATENT DOCUMENTS

| | | | |
|---|---|---|---|
| 626900 | 8/1978 | U.S.S.R. | 83/694 |

OTHER PUBLICATIONS 1982-1983 Catalog of the Shaffer Division, NL Industries, Inc., pp. 6151-6156, 6157, 6163 and 6172; 1982.

General Catalog 1982-1983, Cameron Iron Works, Inc., pp. 1604-1621; 1982.

Catalog 822, Hydril Mechanical Products Division, 1982, The Hydril Company, Los Angeles, Calif., pp. 66-69, 1982.

*Primary Examiner*—James A. Leppink
*Assistant Examiner*—Hoang C. Dang
*Attorney, Agent, or Firm*—Browning, Bushman, Zamecki & Anderson

[57] ABSTRACT

A shear ram-type blowout preventer for severing and sealing a drill pipe string comprises a housing having a throughway for receipt of the drill pipe. Opposed first and second ram assemblies are mounted in the housing on opposite sides of the throughway for reciprocation laterally inwardly and outwardly. Each of the ram assemblies comprises a carrier connected to a drive member for effecting such reciprocation, and a ram block carried on the laterally inward side of the carrier. The maximum thickness of the block is generally equal to the maximum thickness of the carrier measured longitudinally of the throughway. The first ram assembly comprises a blade member carried on the ram block and including a cutting portion extending generally laterally inwardly and a mounting shank extending generally upwardly from the cutting portion. The shank is attached to the ram block by generally horizontally disposed pins. The ram block of the second ram assembly defines a recess opening laterally inwardly for receipt of the blade, and the seal of the second ram assembly comprises a blade sealing element facing longitudinally into said recess. The second ram assembly further comprises a seal actuator for actuating the blade sealing element. The blade sealing element and actuator have opposed, longitudinally facing support surfaces, the support surface of the blade sealing element being defined by a laterally outermost rigid support portion thereof, bonded to a laterally innermost deformable sealing portion. The carrier of the second ram assembly may alternatively mount a pipe ram assembly.

42 Claims, 10 Drawing Figures

FIG. 6
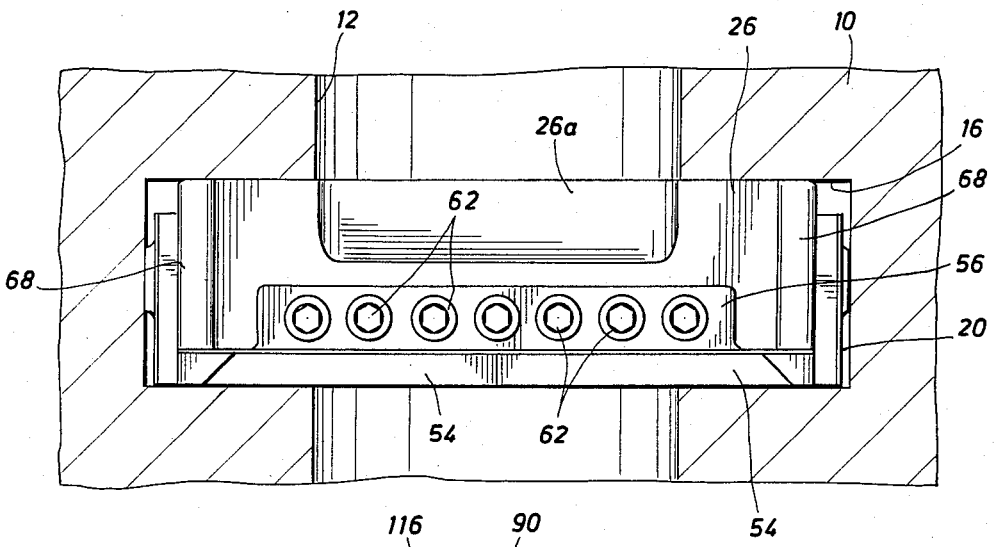
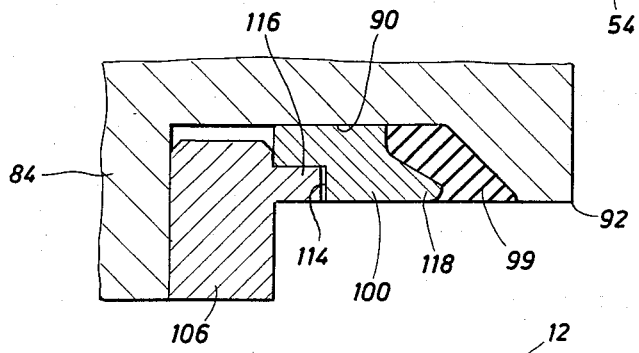
FIG. 8
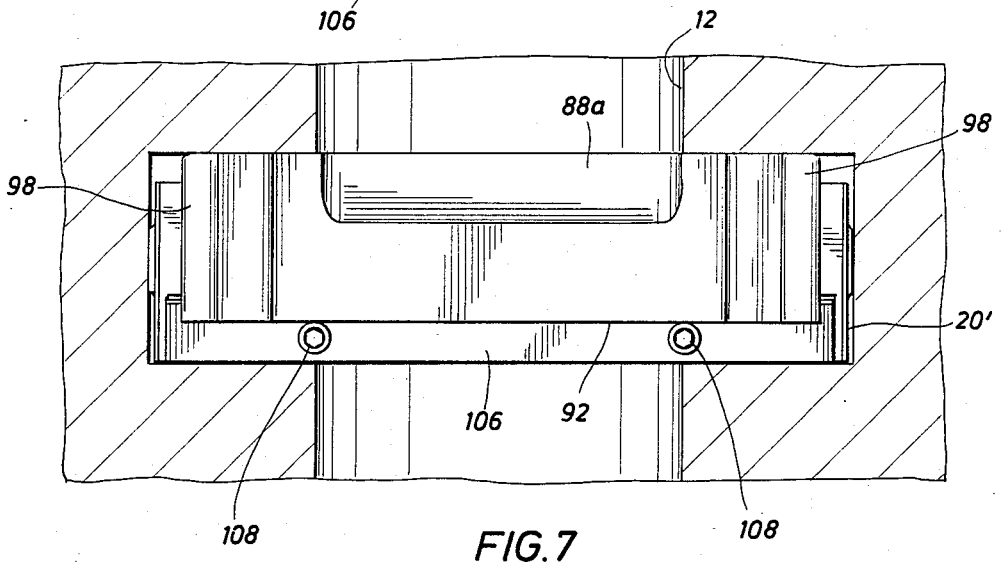
FIG. 7

SHEAR RAM APPARATUS

BACKGROUND OF THE INVENTION

The present invention pertains to blowout preventers used for sealing off oil or gas wells during emergency situations so as to contain dangerous blowouts. Several different general types of blowout preventers are known in the art. One of these is the ram-type blowout preventer, which typically includes a housing having a throughway for the drill pipe. First and second ram assemblies are mounted in the housing on opposite sides of the throughway. These assemblies may be reciprocated laterally inwardly and outwardly, i.e. toward and away from each other, and specifically, are moved inwardly to close the blowout preventer when it becomes necessary to seal off the well.

Ram-type blowout preventers may, in turn, be further subdivided into various types. One type is commonly referred to as the "pipe ram" type. In this type of apparatus, the ram assemblies, when moved laterally inwardly to closed position, simply seal about the outer diameter of the drill pipe thereby sealing off the annulus between the drill pipe and the walls of the well bore. Another kind of ram-type blowout preventer is commonly referred to as "shear ram" type. In this type, the ram assemblies, when reciprocated inwardly, actually sever the drill pipe and subsequently seal against each other in such a way that both the drill pipe itself and the surrounding annulus are sealed off in the sense that they are blocked from communication with the space above the blowout preventer. Both pipe rams and shear rams are typically included in a complete blowout preventer stack for a well.

Exemplary prior pipe ram assemblies are disclosed in U.S. Pat. No. 3,434,729 to Shaffer et al and in the 1982–83 Catalog of the Shaffer Division, NL Industries, Inc., pages 6151–6156, 6162, 6180, and 6189. Exemplary shear ram type blowout preventers are disclosed in U.S. Pat. No. 3,736,982 to Vujasinovic and in the 1982–83 Catalog of the Shaffer Division, NL Industries, Inc., pages 6157, 6163 and 6172. A common characteristic of these pipe ram and shear ram blowout preventers is that each individual ram assembly comprises a carrier or holder of some type and a ram block connected to the carrier for limited relative lateral movement by a lost motion connection. Thus, these structures may be distinguished from other forms of blowout preventers in which the individual ram structures are more or less integral, as exemplified by U.S. Pat. Nos. 4,132,267, 4,313,496, 4,341,264, 4,132,266, and 4,347,898.

One advantage of the former kind of construction, i.e. that in which each ram assembly comprises a relatively movable carrier and ram block, is that a seal may be installed between the carrier and ram block, and such seal may be compressively actuated by relative movement of the carrier and ram block. More specifically, and as described more fully in the aforementioned patents and catalog, as the ram assemblies are moved inwardly, such movement of the ram blocks will eventually be arrested, whereupon the carriers may continue moving inwardly for a limited distance. This actuates the seals between the blocks and carriers.

If the blowout preventer is of the "pipe ram" type, which simply seals about the outer diameter of the drill pipe, it is fairly convenient to design the structure so that the thicknesses of the ram block and carrier, measured longitudinally with respect to the drill pipe, are generally equal. This is desirable because it maximizes the surface area over which the forces may be distributed.

However, in shear ram type blowout preventers, due to the need to provide for actual severing of the drill pipe, and also to the significantly different sealing requirements, the carriers have traditionally been designed to provide a shelf-like structure which underlies and supports its respective ram block. Thus, the maximum thickness of the carrier was, of necessity, substantially greater than that of the ram block. Since the ability of the apparatus to seal off well pressures of a given magnitude is ultimately a function of the longitudinal thickness of the ram block, this proved to be a limiting factor in such prior art devices. To put it another way, it was necessary to make the carriers of the shear ram assemblies thicker than might ideally be desired in order to allow for adequate thickness of the ram blocks.

Another problem with such prior shear ram assemblies revolved around the fact that the shearing blades were mounted on the carriers, rather than the ram blocks, in an effort to avoid possible premature actuation of the seals. However, with this arrangement, and again due to limitations on the desirable thicknesses of various parts, it was conventional to mount the blades to the carriers with vertically disposed pins which, if broken, would almost surely fall downwardly, possibly interfering with other apparatus in and about the well.

SUMMARY OF THE INVENTION

The present invention provides an improved shear ram apparatus of the type in which each of two opposed ram assemblies comprises a carrier and a ram block, and in which the maximum thickness of the ram block is generally equal to the maximum thickness of the carrier, measured longitudinally of the drill pipe throughway. One of the most basic advantages achieved by this arrangement is that a pair of opposed ram assemblies of a given size can contain or seal off a significantly higher pressure than is possible with previous designs.

This maximization of the longitudinal thickness of the ram blocks was, in part, made possible by the surprising discovery that the pipe shearing blade member, traditionally mounted on the carrier of a more conventional shear ram assembly, could be mounted directly on the ram block without any significant danger of premature seal activation, while nevertheless retaining conventional lost motion action to compressively actuate the seals.

This discovery also made it possible to use an improved blade design, wherein the blade includes a cutting portion extending generally laterally inwardly and a mounting shank extending generally upwardly from the cutting portion and attached to the ram block by generally horizontally disposed pin-type connector means. The latter are somewhat less likely to be broken off in use, and even if they are broken, are less likely to fall down into the well. This improved blade design and mounting arrangement are incorporated in what will be referred to herein as the "first" of the two opposed ram assemblies in the apparatus.

The second of these ram assemblies includes additional improvements, which are likewise cooperative with the maximization of the ram block thickness. In particular, the second ram assembly defines a laterally inwardly opening recess for receipt of the blade member of the first ram assembly upon closing of the blowout preventer. The second ram assembly further comprises a seal, at least a part of which faces downwardly into the aforementioned recess for sealing against the upper surface of the blade. This part of the seal is referred to herein as the "blade sealing element."

In conventional arrangements, as exemplified by U.S. Pat. No. 3,736,982, the recess was defined jointly by the ram block and the underlying support shelf of its carrier or holder, and the carrier directly actuated the blade sealing element of the seal as it moved inwardly relative to the ram block upon complete closing of the apparatus. In the present invention, by way of contrast, with the thickness of the ram block extending for generally the full longitudinal thickness of its carrier, i.e. with the supporting shelf eliminated, the carrier does not define or face into the recess.

Accordingly, in order to provide for positive actuation of the blade sealing element, a seal actuator element is disposed in laterally outward backing relation to the blade sealing element. The seal actuator element is mounted on the ram block, such mounting is of a lost motion type permitting limited lateral movement of the actuator element with respect to the ram block. The carrier is in laterally outward backing relation to the actuator element. Therefore, when the ram assembly is moved laterally inwardly during the closing procedure, and when such inward movement of the ram block is arrested, the carrier continues to move laterally inwardly with respect to the ram block, thereby causing the actuator element to move laterally inwardly with respect to the blade sealing element for compressive actuation thereof.

In preferred embodiments, the carrier of the second ram assembly comprises a pair of arms partially peripherally surrounding the ram block generally on the laterally outer side thereof. The blade sealing element of the seal and the actuator element both extend transversely across the carrier generally between the free ends of its arms. Recalling that the actuator element is actually carried by the block, the free ends of the arms need only have simple notches removably receiving the ends of the actuator element and defining abutment surfaces for the aforementioned laterally outward backing of the actuator element. Thus, that same carrier may alternatively mount a pipe ram block, as opposed to a shear ram block, since the seal actuator element is removable, and the notches in the carrier arms in no way interfere with proper mounting and operation of the pipe ram block in the carrier.

Thus, the unique manner of actuating the blade sealing element not only cooperates to make possible maximization of the thickness of the shear ram block, or elimination of a supporting shelf in the carrier, but also allows for convenient and economic standardization of parts, whereby the same design carrier can alternatively mount shear ram blocks according to the present invention as well as more conventional pipe ram blocks.

Still other improvements have been incorporated in the seal itself, and in particular, in the blade sealing element. This element is preferably formed so as to define a laterally outwardly opening recess having a downwardly facing support surface. The aforementioned seal actuator element is formed with a cooperative upwardly facing support surface. Further, the blade sealing element may preferably be comprised of two portions, a laterally innermost deformable sealing portion, and a laterally outermost rigid support portion, defining the aforementioned support surface. Preferably, the support portion is comprised of a different material from the sealing portion and bonded thereto.

Accordingly, it is a principal object of the present invention to provide an improved shear ram apparatus having opposed first and second ram assemblies, each comprising a carrier and a ram block of generally equal maximum thickness.

It is another object of the present invention to provide a shear ram apparatus in which a blade member comprises a laterally extending cutting portion and an upwardly extending mounting shank, attached to a ram block by generally horizontally disposed pin-type connector means.

Still another object of the present invention is to provide a shear ram apparatus having improved means for actuating a seal element for sealing longitudinally against the blade member.

A further object of the present invention is to provide an improved carrier capable of alternatively mounting a shear ram block or a pipe ram block.

Yet another object of the present invention is to provide an improved seal for a ram assembly.

Still other objects, features, and advantages of the present invention will be made apparent by the following detailed description, the drawings and the claims.

BRIEF DESCRIPTION OF THE DRAWINGS

FIG. 6 is a front elevational view of the laterally inner side of the first ram assembly taken along the line 6—6 in FIG. 1.

FIG. 7 is a front elevational view of the laterally inner side of the second ram assembly taken along the line 7—7 in FIG. 1.

FIG. 8 is a detailed sectional view taken on the line 8—8 in FIG. 5.

DETAILED DESCRIPTION

Figure 1:
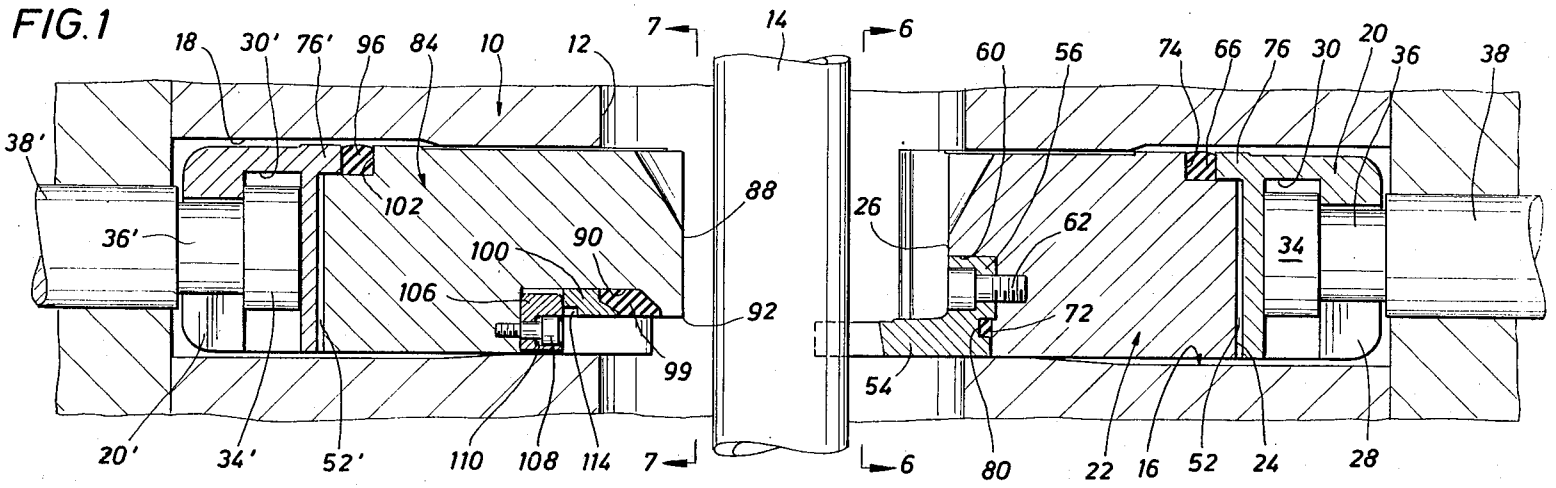
FIG. 1 is a longitudinal cross-sectional view through a shear ram blowout preventer apparatus according to the present invention, showing the ram assemblies in open position.

Referring to FIG. 1, there is shown a ram-type blowout preventer, and more specifically, a shear ram apparatus comprising a housing 10. Housing 10 defines a central throughway 12, disposed generally vertically in use, for receipt of a string of drill pipe, a portion of which is shown at 14. As used herein, terms such as "longitudinally" and "laterally" should be construed with reference to the centerline of throughway 12 unless otherwise indicated, and for convenience, it is noted that this centerline is generally coincident with that of the drill pipe 14 in use. Also for convenience, terms such as "vertically" and "horizontally" will be used with reference to the positions normally assumed by various parts of the apparatus in use, and should not be construed in a limiting sense.

Housing 10 defines a pair of chambers 16 and 18 on laterally opposite sides of and communicating with throughway 12. Chambers 16 and 18 are substantially identical, and house, respectively, first and second ram assemblies.

Figure 3:
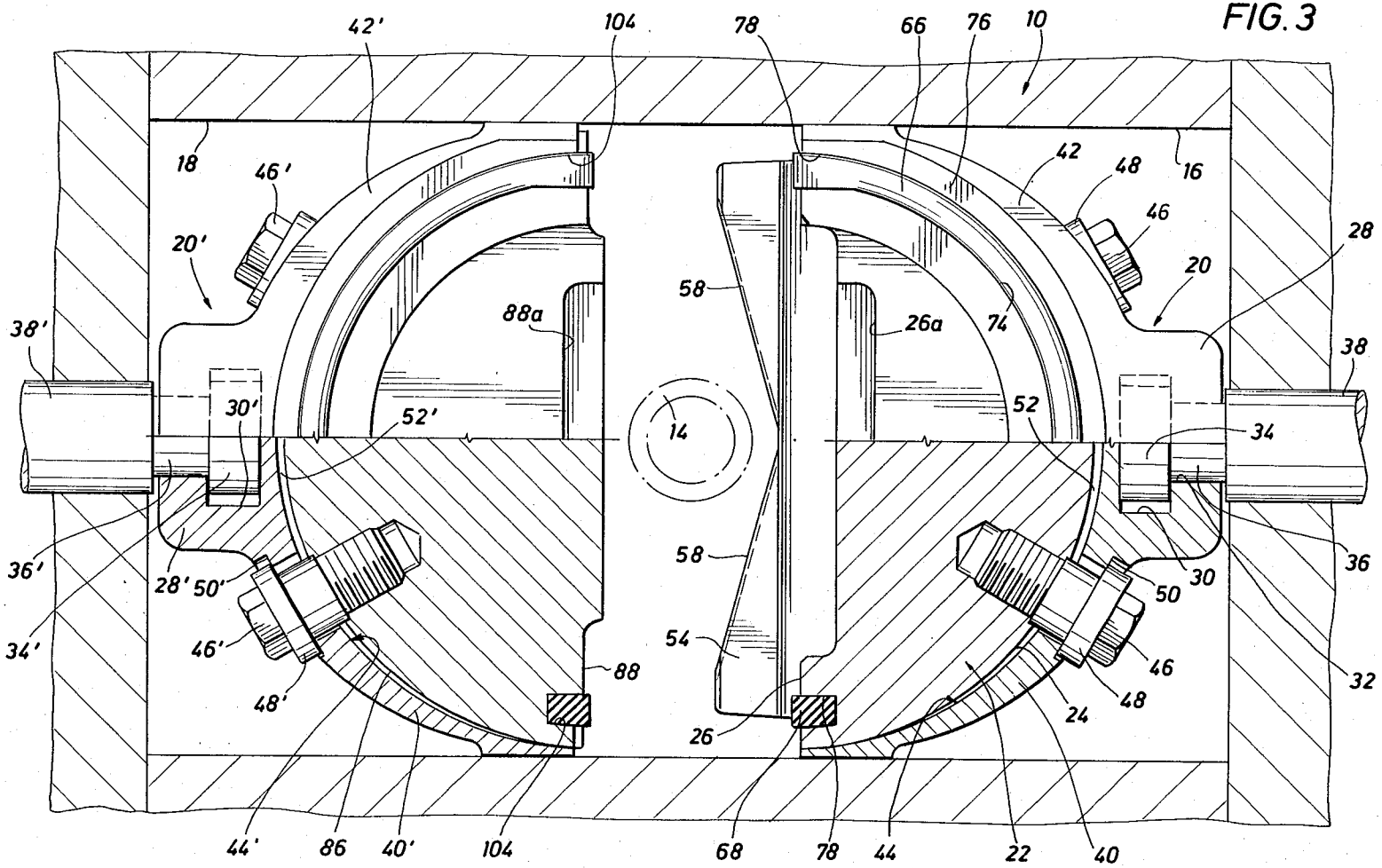
FIG. 3 is a top plan view of the ram assemblies in open position, with parts being shown in transverse cross section.

The first ram assembly, housed in chamber 16, comprises a carrier 20 and a ram block 22 mounted on the laterally inner side of carrier 20. Referring now jointly to FIGS. 1, 3 and 6, ram block 22 may be very generally described as having an arcuate laterally outer side 24 and a laterally inner side 26 which extends transversely between the ends of the arc of outer side 24.

Carrier 20 has a base 28 with a cavity 30 therein. Cavity 30 has a reduced diameter mouth 32 opening laterally outwardly through base 28. Cavity 30 receives a flange member 34 connected by a reduced diameter neck 36 to a piston rod 38, neck 36 extending through mouth 32 of cavity 30, and piston rod 38 being located outwardly thereof. Because of the reduced diameters of mouth 32 and neck 36, flange 34 and piston rod 38 form opposed shoulders abutting base portion 28 of carrier 20. In a manner well known in the art, piston rod 38 is connected to a piston housed in a cylinder integral with housing 10. Thus, piston rod 38 serves as a drive member whereby carrier 20 may be reciprocated laterally inwardly and outwardly.

Carrier 20 further comprises a pair of arcuate arms 40 and 42 extending away from base portion 28 in opposite directions to form a generally arcuate recess 44 for peripherally surrounding the laterally outer side 24 of ram block 22. Recess 44 thus opens laterally inwardly, and in addition, as best shown in FIG. 1, recess 44 also opens both upwardly and downwardly throughout substantially its full lateral depth. In other words, carrier 20 does not include a shelf-like support for underlying ram block 22, as in more conventional prior art shear ram assemblies.

Ram block 22 is connected to carrier 20 by a lost motion-type mechanism whereby ram block 22 will, in general, be reciprocated jointly with carrier 20 by drive member 38, but in addition, will be permitted some limited lateral movement or play with respect to carrier 20. Specifically, each of the carrier arms 40 and 42 has a respective bolt 46 extending loosely therethrough and threaded into an adjacent portion of ram block 22. Each of the bolts 46 has a flange 48 at its head end, and as shown in the lower half of FIG. 3, the flange 48 abuts a shoulder 50 on carrier 20 to limit laterally inward movement of the attached block 22 with respect to carrier 20. Bolts 46 do not, however, limit relative laterally outward movement of ram block 22 with respect to carrier 20, the latter being limited by direct abutment of the ram block and carrier.

As shown, when flanges 48 are in abutment with shoulders 50, there is a lateral gap 52 between the ram block 22 and its carrier 20. Accordingly, when the ram assembly as a whole is moved laterally inwardly by drive member 38, and when such movement of ram block 22 is arrested, as will be described more fully hereinbelow, carrier 20 can continue its laterally inward movement for a distance determined by the depth of gap 52. As will be described more fully below, this lost motion arrangement compressively actuates a seal, the seal in turn serving to normally bias the ram block and carrier laterally away from each other, i.e. to maintain the gap 52.

Again referring to FIG. 1, and recalling that the recess 44 of carrier 20 is fully open in the downward direction, it can be seen that the maximum thickness of ram block 22, measured in the longitudinal direction, is generally equal to the maximum thickness of carrier 20, measured in the same direction. This in turn maximizes the surface area over which the forces may be distributed in operation.

The first ram assembly further comprises a blade member which is generally L-shaped in cross section, having a laterally inwardly extending cutting portion 54 and a mounting shank 56 extending upwardly from the laterally outer extremity of the cutting portion 54. As shown in FIG. 3, cutting portion 54, as viewed in plan, has a shallow notch formed by oppositely inclined edges 58 to increase its contact area with the drill pipe 14. The laterally inner side 26 of block 22 has, at its lower corner, an undercut formation 60 configured to receive mounting shank 56 of the blade member. Shank 56 is connected to block 22 by horizontally disposed screws 62. Because of their orientation and disposition relative to the L-shaped blade member 54, 56, screws 62 are less likely to break off in use than conventional vertical connectors. Even if they should break off, they will, for similar reasons, be less likely to cause complications by falling downwardly into the well.

Figure 9:
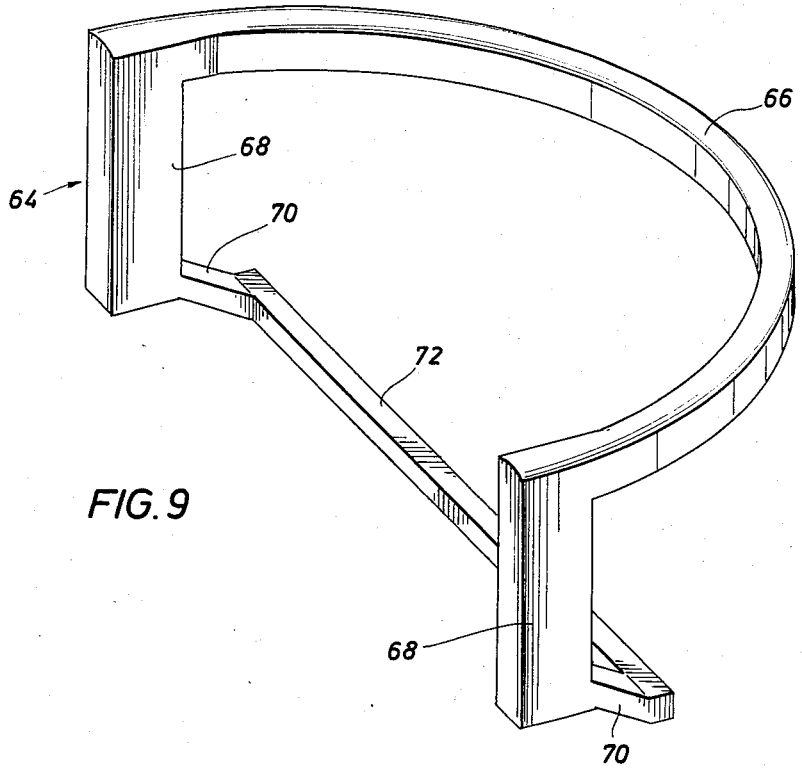
FIG. 9 is a perspective view of the first seal.

The first assembly further comprises a first seal, shown in FIG. 9 and generally denoted by the numeral 64. Seal 64 is a monolithic elastomeric body comprising an arcuate run 66 which, in use, opens laterally inwardly. Thus, for convenience, the direction in which the arc of run 66 opens will be considered a laterally inward direction for purposes of description of seal 64 per se, and the longitudinal direction will be defined by the centerline of arcuate run 66, which in use is parallel to the centerline of the apparatus as a whole. The opposite ends of arcuate run 66 are slightly thickened, as shown, and the seal further comprises a pair of longitudinal, and more particularly vertical runs 68 extending downwardly from the opposite end portions of run 66. Connected to the lower ends of runs 68 are, respectively, a pair of spacer runs 70, which are inclined downwardly and laterally outwardly from the lower ends of runs 68. Finally, seal 64 has a transverse run 72, rectilinear in form, interconnecting the lower outer ends of runs 70.

The disposition of the various parts of seal 64 relative to the remainder of the first ram assembly is best understood by comparison of FIGS. 1, 3, 5 and 6. Ram block 22 has its arcuate upper outer edge inset at 74 to receive arcuate run 66 of the seal. Carrier 20 has, at its upper and laterally inner arcuate edge, a flange 76 extending into inset 74 to laterally outwardly abut seal run 66. Inner side 26 of block 22 has, generally adjacent its opposite ends, a pair of vertical grooves 78 which receive seal runs 68. (See FIG. 3) Grooves 78 are sized such that seal runs 68 will project slightly laterally inwardly beyond block face 26. Runs 70 and 72 are received in a corresponding groove system 80 in the mounting shank 56 of the blade member. Thus, run 66 seals between the ram block 22 and its carrier 20, and normally biases the ram block and carrier laterally away from each other so as to maintain gap 52. Runs 70 and 72 seal between the ram block and blade. When the blowout preventer is closed, runs 68 seal against the second ram assembly, and run 66 further seals against the housing, in a manner to be described more fully below.

The second ram assembly, which is housed in chamber 18, likewise comprises a carrier 20' mounting a ram block 84. Carrier 20', its drive means (piston rod 38') and its manner of lost motion connection to its respective ram block 84 are all substantially identical to those for the carrier 20 of the first ram assembly. Therefore, carrier 20' will not be described in detail, but parts of the second ram assembly, including its carrier 20', which are substantially identical to corresponding parts of the first ram assembly, have been given like reference numerals plus the symbol "'" (prime).

Second ram block 84 is similar to first ram block 22 in that its maximum longitudinal thickness is generally equal to that of its carrier 20'. Also, like block 22, block 84 has an arcuate laterally outer side 86 disposed in the recess 44' formed by arms 40' and 42' of carrier 20', and a transverse laterally inner side 88. Ram block 84 differs from ram block 22 primarily in the formations at and near its inner side 88.

More specifically, at its laterally inner and lowermost edge, block 84 has a recess 90 opening laterally inwardly and downwardly. Adjacent its inner face 88, block 84 extends downwardly to define the laterally inner wall of recess 90 and also to form an anvil 92 which cooperates with cutting portion 54 of the blade member of the first ram assembly to apply a shearing force to drill pipe 14.

Figure 10:
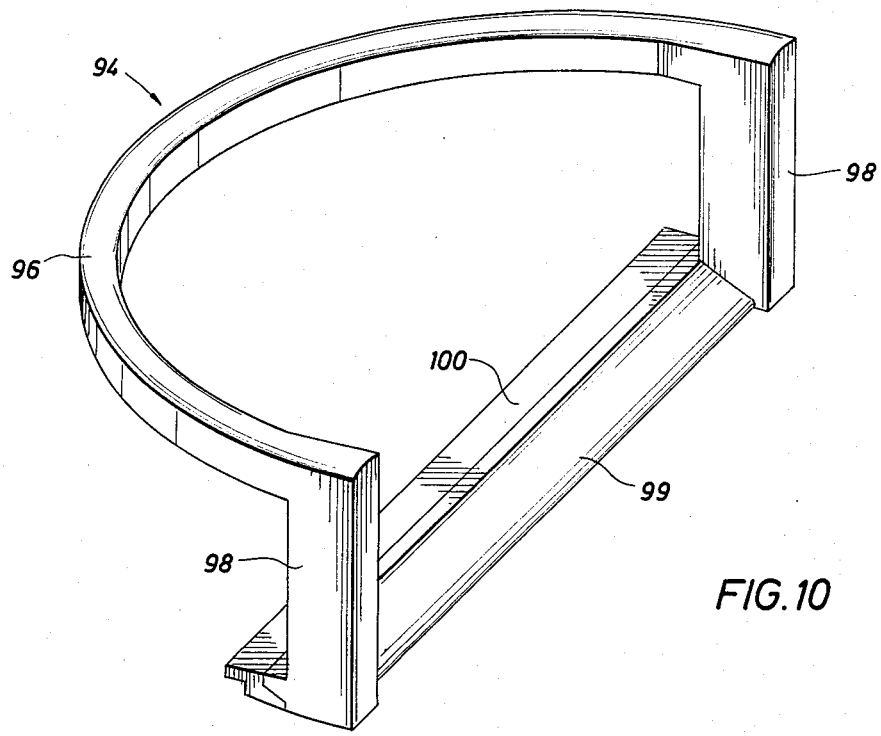
FIG. 10 is a perspective view of the second seal.

Like the first ram assembly, the second ram assembly comprises a seal, which is shown at 94 in FIG. 10, and referred to herein as the "second seal." Lateral and longitudinal directions for seal 94 will be defined in a similar manner as for seal 64. More specifically, seal 94 includes an arcuate run 96 opening laterally inwardly and having thickened end portions. Extending vertically downwardly from the opposite ends of arcuate run 96 are respective connector runs 98. The lower ends of connector runs 98 are interconnected by a transverse run including a laterally innermost deformable sealing portion 99 and a laterally outermost rigid support portion 100. Members 96, 98 and 99 of the seal comprise a monolithic elastomeric body, while element 100 is a metal member bonded to seal member 99. The transverse run 99, 100 is also referred to herein as the "blade sealing element" of the second seal, for reasons to be explained more fully below.

Ram block 84 has it upper laterally outer edge inset at 102 to receive arcuate seal run 96. The projection 76' of carrier 20' extends into inset 102 to laterally outwardly back seal run 96. Seal runs 98 are disposed in grooves 104 of inner side 88 of block 84 and project slightly laterally inwardly therefrom. Transverse run or blade sealing element 99, 100 is disposed in recess 90, with the innermost surface of sealing portion 99 abutting the laterally inner wall of the recess behind anvil 92, and with the lower surface of sealing portion 99 facing downwardly into the recess for sealing engagement with the upper surface of cutting portion 54 of the blade 54, 56.

Due to the lost motion type interconnection between ram block 84 and its carrier 20', the ram assembly, as a whole, may be reciprocated laterally inwardly by its drive means or piston rod 38'. When such laterally inward movement of the ram block 84 is arrested, carrier 20' can continue moving laterally inwardly by a distance sufficient to close gap 52'. Thus, both ram assemblies have a similar lost motion type action. This lost motion action is used to compressively actuate the seals 64 and 94 in a manner which will be described hereinafter. To assist in proper actuation of the sealing portion 99 of the blade sealing element 99, 100 of second seal 94, the second ram assembly is provided with a seal actuator element in the form of a bar 106.

Bar 106 is affixed to block 84 adjacent the laterally outermost (inwardly facing) wall of recess 90 with a lost motion type connection. More specifically, screws 108 extend loosely through bores in bar 106 and are threaded into block 84. The bores in bar 106 which receive screws 108 are counterbored to receive the heads of the screws and thereby form laterally inwardly facing shoulders 110 opposing the screw heads. It can be seen that, when screws 108 are fully threaded into block 84, there are clearances between their heads 108 and the respective shoulders 110.

Figure 5:
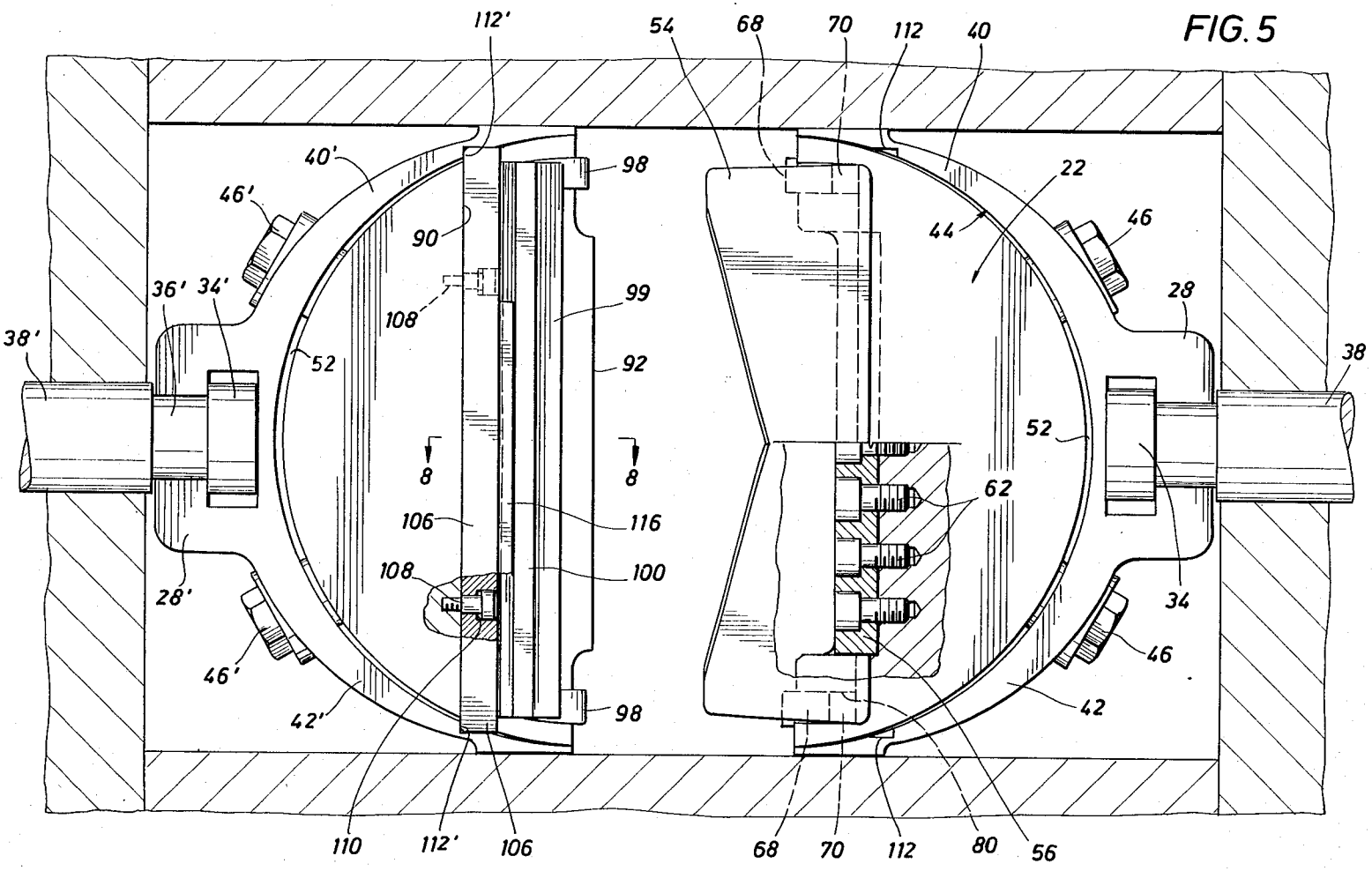
FIG. 5 is a bottom plan view of the ram assemblies, in open position, with parts broken away.

Referring specifically to FIG. 5, it can also be seen that the ends of bar 106 are received in laterally inwardly opening notches 112' in arms 40' and 42' of carrier 20'. Thus, the bottoms of notches 112' are in laterally outward backing relation to bar 106. Thus, when the second ram assembly is moved laterally inwardly, and upon arresting of the inward movement of the block 84, as carrier 20' continues to move inwardly, it will urge bar 106 inwardly along with it, to the extend of the clearance between screw heads 108 and shoulders 110, toward blade sealing element 99, 100. Bar 106 is in a laterally outward backing relation with respect to the blade sealing element, more specifically in abutment with its support portion 100, and therefore, such continued laterally inward movement of bar 106 compresses blade sealing element 99, 100 between bar 106 and anvil formation 92, thereby urging deformable sealing portion 99 downwardly and into tight sealing engagement with blade portion 54.

As best shown in FIGS. 1,5,8 and 10, rigid support portion 100 of the blade sealing element is undercut along its laterally outer and lowermost edge, as indicated at 114, to form a downwardly facing support surface. Bar 106 has a lip or tongue 116 extending laterally inwardly and into undercut 114 and forms an upwardly facing support surface for abutment with the opposed surface of undercut 114. Thus, bar 106 supports support portion 100 of the blade sealing element. Portion 100 in turn has an extension 118 which partially underlies sealing portion 99, thereby giving it even further support.

As previously mentioned, carriers 20 and 20' are virtually identical. Thus, as shown in FIG. 5, carrier 20 includes notches 112 corresponding to the notches 112' of carrier 20'. These notches serve no purpose in carrier 20, but on the other hand, they in no way interfere with proper operation of carrier 20. Therefore, while the notches could be eliminated from the carrier on the blade side of the apparatus, one of the advantages of the present invention is that more parts may be standardized and, in particular, identical carriers can be used to mount both the ram blocks of the blowout preventer.

Indeed, these same carriers can also be used to mount pipe ram blocks. The notches are disposed and configured such that they in no way interfere with proper mounting or operation of such pipe ram blocks.

Figure 2:
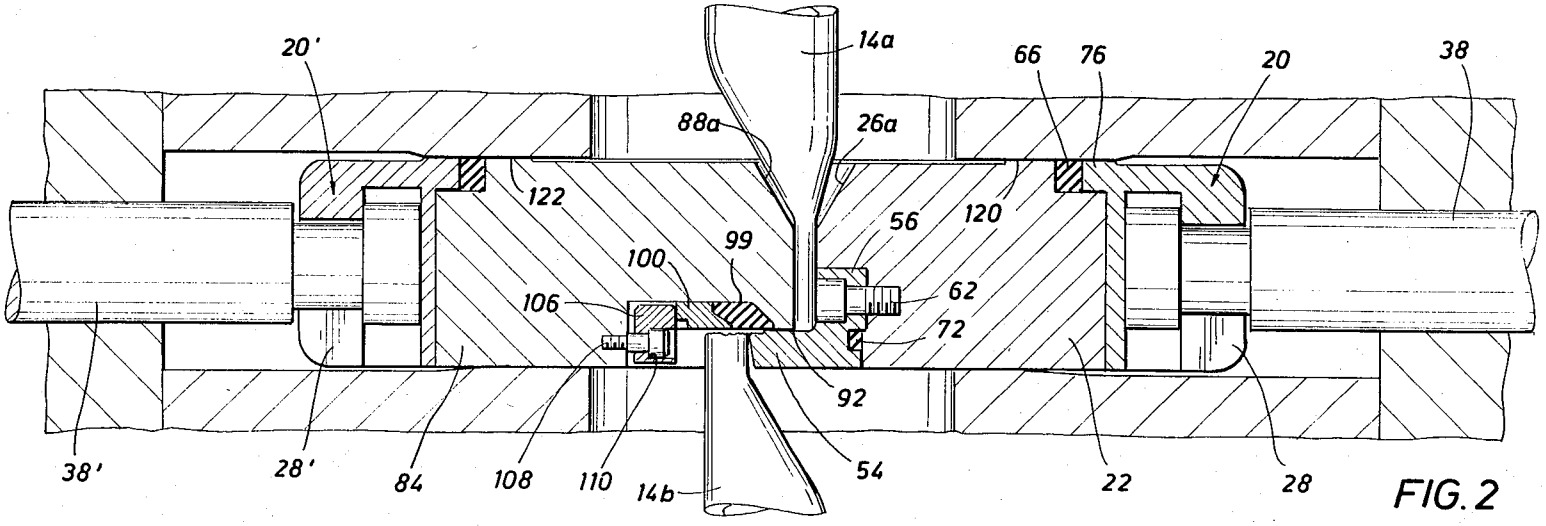
FIG. 2 is a view similar to FIG. 1 showing the ram assemblies in closed position with the drill pipe severed.
Figure 4:
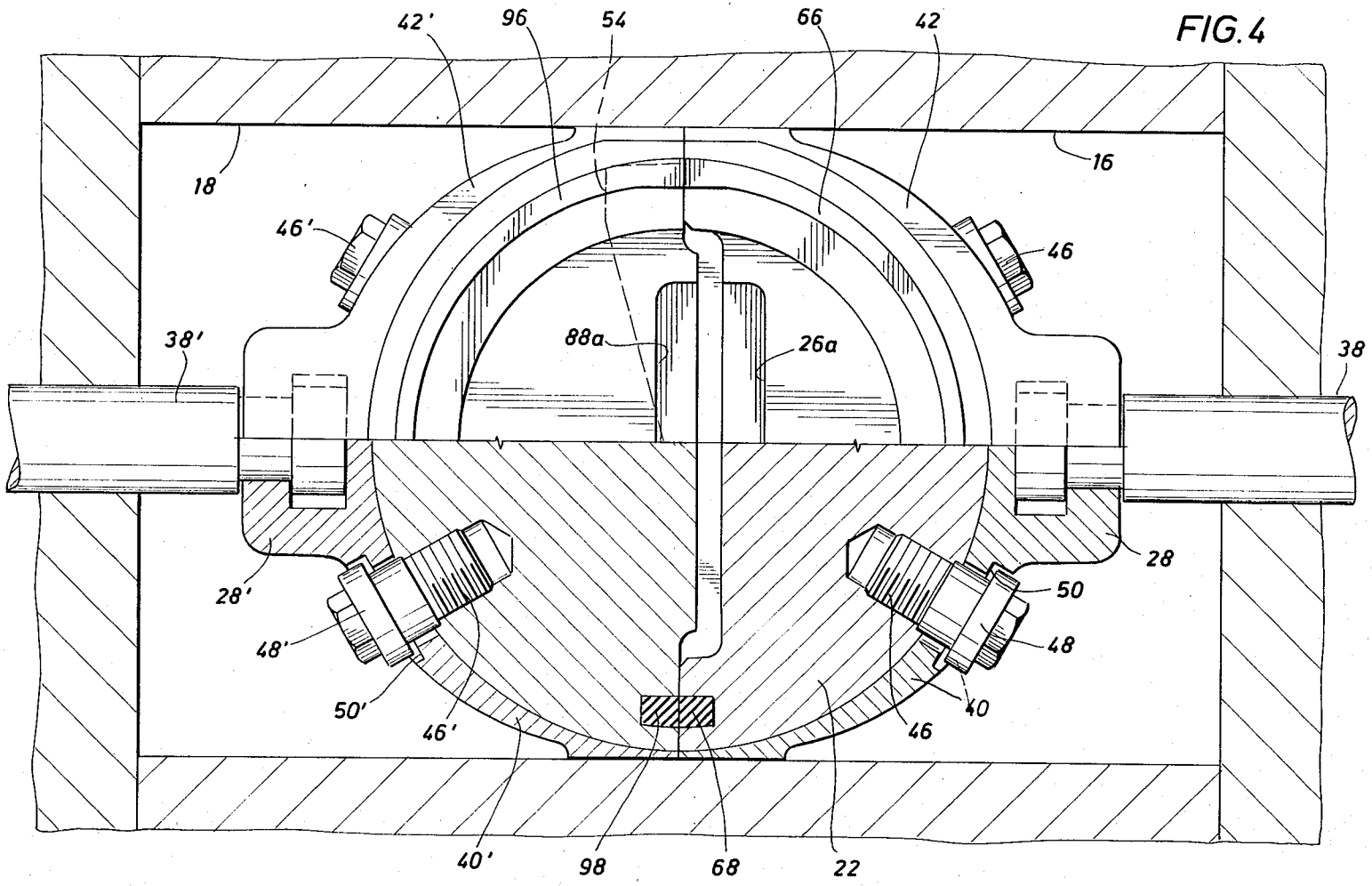
FIG. 4 is a view similar to that of FIG. 3 showing the ram assemblies in closed position.

In order to close the blowout preventer, i.e. to sever and seal off a string of drill pipe, both first and second ram assemblies are moved laterally inwardly to the positions shown in FIGS. 2 and 4. Cutting portion 54 of the blade of the first assembly, and anvil formation 92 of the second ram assembly, will apply a shearing force so as to sever the drill pipe 14 into two fragments, 14*a* and 14*b*. The severed lower end of the upper fragment 14*a* is collapsed between the inner faces 26 and 88 of the ram blocks. The upper portions of these faces are inset and chamferred as shown at 26*a* and 88*a*, to receive an adjacent portion of the pipe fragment which is not completely collapsed. Eventually, laterally inward movement of the ram blocks 22 and 84 will be arrested. By this time, the vertical runs 68 of the first seal will have come into abutment with the vertical runs 98 of the second seal.

Also, arcuate seal runs 66 and 96 will have been brought into engagement with respective upsets 120 and 122 formed on the upper walls of chambers 16 and 18. Thus, runs 66 and 96 will form a full annular seal in the upper portion of the housing about throughway 12. To insure that seal runs 66 and 96 engage upsets 120 and 122, the lower walls of chambers 16 and 18 are very gradually tapered upwardly and laterally inwardly.

Meanwhile, the cutting portion 54 of the blade will have moved into at least partial alignment with the sealing portion 99 of the blade sealing element, and the severed upper end of pipe fragment 14*b* will be received in recess 90. Thus, blade sealing element 99 and runs 68 and 98 seal between the two ram assemblies, and runs 66 and 96 seal between the respective ram blocks and their carriers as well as between the ram assemblies and housing about the locus of throughway 12. Accordingly, both the interior of pipe fragment 14*b* and the well annulus are sealed off. It is noted that references herein to the pipe as being sealed are intended in the general sense that the pipe is blocked from communication with the space above the blowout preventer, and do not mean that a seal is formed across the pipe per se.

As the carriers 20 and 20' continue to move inwardly by virtue of the lost motion connections, seal portion 99 is activated and tightened as described above, and runs 66 and 96 are activated and tightened by compression between their respective ram blocks and carriers. With the ram assemblies in their fully closed positions, as shown in FIGS. 2 and 4, gaps 52 and 52' are closed, and clearances have been created between bolt flanges 48 and shoulders 50 and between bolt flanges 48' and shoulders 50'. Also, the clearances between shoulders 110 and the heads of screws 108 have been closed, there now being clearance between the bar 106 and block 84.

Numerous modifications of the exemplary embodiment described above are possible within the spirit of the invention. Accordingly, it is intended that the scope of the invention be limited only by the claims which follow.

What is claimed is:

1. Shear ram apparatus for severing and sealing a string of drill pipe comprising:

a housing body having a throughway for receipt of said drill pipe;

and opposed first and second ram assemblies mounted in said housing body on opposite sides of said throughway for reciprocation laterally inwardly and outwardly, each of said ram assemblies comprising a carrier connected to a drive means for effecting such reciprocation, and a ram block carried on the laterally inward side of said carrier, the maximum thickness of said block being generally equal to the maximum thickness of said carrier measured generally longitudinally of said throughway;

said first ram assembly further comprising a blade member carried on its ram block;

said second ram assembly having, on its ram block, an anvil formation positioned for cooperation with said blade member to apply a shearing force to said drill pipe when said ram assemblies are moved laterally inwardly;

in said second ram assembly, said ram block being connected to said carrier for limited relative lateral movement such that, upon movement of said second ram assembly laterally inwardly, and further upon arresting of such laterally inward movement of said ram block, said carrier may continue such laterally inward movement for a limited distance;

said second ram assembly further comprising second seal means cooperative between said ram block and said carrier for compressive actuation by such continued laterally inward movement of said carrier with respect to said ram block;

said ram block of said second ram assembly defining a recess opening laterally inwardly toward said throughway for receipt of said blade member when said ram assemblies are moved laterally inwardly;

said second seal means comprising a blade sealing element facing longitudinally into said recess for sealing against a longitudinally facing surface of said blade member;

and said second ram assembly further comprising a seal actuator element disposed in laterally outward backing relation to said blade sealing element and in lateral alignment with said ram block generally within the longitudinal extremities of said maximum thickness, said actuator element being mounted on said ram block for limited lateral movement with respect to said ram block, and said carrier of said second ram assembly being in laterally outward backing relation to said actuator element, whereby, upon such continued laterally inward movement of said carrier with respect to said ram block, said actuator element is moved laterally inwardly with respect to said blade sealing element.

2. The apparatus of claim 1 wherein said blade member comprises a cutting portion extending generally laterally inwardly and a mounting shank extending generally upwardly from said cutting portion and attached to said ram block.

3. The apparatus of claim 2 wherein said blade member is generally L-shaped in cross section, having one leg forming said cutting portion and the other leg forming said mounting shank;

and wherein said mounting shank is attached to said ram block by generally horizontally disposed pin-type connector means.

4. The apparatus of claim 1 wherein, in said first ram assembly, said ram block is connected to said carrier for limited relative lateral movement such that, upon movement of said first ram assembly laterally inwardly, and further upon arresting of such laterally inward movement of said ram block, said carrier may continue such laterally inward movement for a limited distance.

5. The apparatus of claim 4 wherein said first ram assembly further comprises first seal means cooperative between said ram block and said carrier for compressive actuation by such continued laterally inward movement of said carrier with respect to said ram block.

6. The apparatus of claim 1 wherein said anvil formation is in laterally inward backing relation to said blade sealing element, whereby, upon such inward movement of said actuator element with respect to said blade sealing element, said blade sealing element is laterally compressed between said actuator element and said anvil formation and urged longitudinally toward said blade member.

7. The apparatus of claim 6 wherein said actuator element is disposed generally within said recess.

8. The apparatus of claim 7 wherein said actuator element has a support surface underlying a portion of said blade sealing element.

9. The apparatus of claim 8 wherein said blade sealing element has a deformable sealing portion adjacent said anvil formation and a rigid support portion cooperative with said support surface of said actuator element.

10. The apparatus of claim 9 wherein said support surface is defined by a lip extending laterally inwardly from said actuator element;

and said support portion of said blade sealing element is undercut to receive said lip.

11. The apparatus of claim 10 wherein said sealing and support portions of said blade sealing element are bonded together;

and said support portion has an extension underlying a part of said sealing portion.

12. The apparatus of claim 9 wherein said sealing and support portions of said blade sealing element are bonded together;

and said support portion has an extension underlying a part of said sealing portion.

13. The apparatus of claim 8 wherein said recess is defined by downwardly and laterally inwardly facing surfaces of said ram block of said second ram assembly;

said anvil formation and said blade sealing element are disposed adjacent the downwardly facing surface of said recess, and said actuator element is attached to said ram block adjacent said inwardly facing surface of said recess.

14. The apparatus of claim 13 wherein said actuator element is so attached to said ram block by generally horizontally disposed pin-type connector means.

15. The apparatus of claim 6 wherein said carrier of said second ram assembly comprises a pair of arms partially peripherally surrounding said ram block generally on the laterally outer side thereof;

said blade sealing element and said actuator element extend transversely across said carrier generally between the free ends of said arms;

and the free ends of said arms have notches removably receiving the ends of said actuator element and defining abutment surfaces for said laterally outward backing thereof.

16. The apparatus of claim 1 wherein, in said first ram assembly, said ram block is connected to said carrier for limited relative lateral movement such that, upon movement of said first ram assembly laterally inwardly, and further upon arresting of such laterally inward movement of said ram block, said carrier may continue such laterally inward movement for a limited distance;

and said first ram assembly further comprises first seal means cooperative between said ram block and said carrier for compressive actuation by such continued laterally inward movement of said carrier with respect to said ram block.

17. The apparatus of claim 16 wherein said blade member comprises a cutting portion extending generally laterally inwardly and a mounting shank extending generally upwardly from said cutting portion and attached to said ram block of said first ram assembly by generally horizontally disposed pin-type connector means.

18. Shear ram apparatus for severing and sealing a string of drill pipe comprising:

a housing body having a throughway for receipt of said drill pipe;

and opposed first and second ram assemblies mounted in said housing body on opposite sides of said throughway for reciprocation laterally inwardly and outwardly, each of said ram assemblies comprising a carrier connected to a drive means for effecting such reciprocation and a ram block carried on the laterally inward side of said carrier;

said first ram assembly further comprising a blade member carried on said ram block, said blade member including a cutting portion extending generally laterally inwardly and a mounting shank extending generally upwardly from said cutting portion and attached to said ram block by generally horizontally disposed pin-type connector means.

19. The apparatus of claim 18 wherein said blade member is generally L-shaped in cross section, having one leg forming said cutting portion and the other leg forming said mounting shank.

20. The apparatus of claim 18 wherein, in said first ram assembly, said ram block is connected to said carrier for limited relative lateral movement such that, upon movement of said first ram assembly laterally inwardly, and further upon arresting of such laterally inward movement of said ram block, said carrier may continue such laterally inward movement for a limited distance;

and said first ram assembly further comprises first seal means cooperative between said ram block and said carrier for compressive actuation by such continued laterally inward movement of said carrier with respect to said ram block.

21. Shear ram apparatus for severing and sealing a string of drill pipe comprising:

a housing body having a throughway for receipt of said drill pipe;

and opposed first and second ram assemblies mounted in said housing body on opposite sides of said throughway for reciprocation laterally inwardly and outwardly, each of said ram assemblies comprising a carrier connected to a drive means for effecting such reciprocation, and a ram block carried on the laterally inward side of said carrier;

said first ram assembly further comprising a blade member carried on its ram block;

said second ram assembly having, on its ram block, an anvil formation positioned for cooperation with said blade member to apply a shearing force to said drill pipe when said ram assemblies are moved laterally inwardly;

in said second ram assembly, said ram block being connected to said carrier for limited relative lateral movement such that, upon movement of said second ram assembly laterally inwardly, and further upon arresting of such laterally inward movement of said ram block, said carrier may continue such laterally inward movement for a limited distance;

said second ram assembly further comprising second seal means cooperative between said ram block and said carrier for compressive actuation by such continued laterally inward movement of said carrier with respect to said ram block;

said ram block of said second ram assembly defining a recess opening laterally inwardly toward said throughway for receipt of said blade member when said ram assemblies are moved laterally inwardly;

said second seal means comprising a blade sealing element facing longitudinally into said recess for sealing against a longitudinally facing surface of said blade member;

and said second ram assembly further comprising a seal actuator element disposed generally in said recess in laterally outward backing relation to said blade sealing element and mounted on said ram block for limited lateral movement with respect to said ram block, said carrier of said second ram assembly being in laterally outward backing relation to said actuator element, whereby, upon such continued laterally inward movement of said carrier with respect to said ram block, said actuator element is moved laterally inwardly with respect to said blade sealing element.

22. The apparatus of claim 21 wherein said anvil formation is in laterally inward backing relation to said blade sealing element, whereby, upon such inward movement of said actuator element with respect to said blade sealing element, said blade sealing element is laterally compressed between said actuator element and said anvil formation and urged longitudinally toward said blade member.

23. The apparatus of claim 22 wherein said actuator element has a support surface underlying a portion of said blade sealing element.

24. The apparatus of claim 23 wherein said blade sealing element has a deformable sealing portion adjacent said anvil formation and a rigid support portion cooperative with said support surface of said actuator element.

25. The apparatus of claim 24 wherein said support surface is defined by a lip extending laterally inwardly from said actuator element;

and said support portion of said blade sealing element is undercut to receive said lip.

26. The apparatus of claim 25 wherein said sealing and support portions of said blade sealing elements are bonded together;

and said support portion has an extension underlying a part of said sealing portion.

27. The apparatus of claim 24 wherein said sealing and support portions of said blade sealing elements are bonded together;

and said support portion has an extension underlying a part of said sealing portion.

28. The apparatus of claim 23 wherein said recess is defined by downwardly and laterally inwardly facing surfaces of said ram block of said second ram assembly;

said anvil formation and said blade sealing element are disposed adjacent the downwardly facing surfaces of said recess;

and said actuator element is attached to said ram block adjacent said inwardly facing surface of said recess.

29. The apparatus of claim 28 wherein said actuator element is so attached to said ram block by generally horizontally disposed pin-type connector means.

30. The apparatus of claim 22 wherein said carrier of said second ram assembly comprises a pair of arms partially peripherally surrounding said ram block generally on the laterally outer side thereof;

said blade sealing element and said actuator element extend transversely across said carrier generally between the free ends of said arms;

and the free ends of said arms have notches removably receiving the ends of said actuator element and defining abutment surfaces for said laterally outward backing thereof.

31. A seal for a ram assembly of a reciprocating ram-type blowout preventer comprising:

an arcuate run having opposite end portions and opening in a laterally inward direction;

a pair of connector runs integrally adjoining the respective end portions of said arcuate run and extending generally longitudinally therefrom;

a transverse run integrally adjoining said connector runs and extending therebetween in a position spaced generally longitudinally from said end portions of said arcuate run, said transverse run having a recess opening in a laterally outward direction opposite said laterally inward direction and defining a free support surface facing longitudinally away from said arcuate run.

32. The seal of claim 31 wherein said arcuate run and said transverse run are disposed at longitudinally opposite ends of said connector runs.

33. The seal of claim 32 wherein said recess is defined by an undercut formation extending along substantially the entire length of said transverse run on the laterally outer side thereof.

34. The seal of claim 33 wherein said transverse run comprises a laterally innermost deformable sealing portion and a laterally outermost rigid support portion defining said recess.

35. The seal of claim 34 wherein said support portion is bonded to said sealing portion of said transverse run.

36. The seal of claim 35 wherein said support portion has an extension longitudinally underlying a part of said sealing portion of said transverse run.

37. The seal of claim 32 wherein said transverse run comprises a laterally innermost deformable sealing portion and a laterally outermost rigid support portion defining said recess.

38. The seal of claim 37 wherein said arcuate run, said connector runs and said sealing portion of said transverse run form a monolithic elastomeric body.

39. A seal for a ram assembly of a reciprocating shear ram-type blowout preventer comprising:

an arcuate run having opposite end portions and opening in a laterally inward direction;

a pair of connector runs integrally adjoining respective end portions of said arcuate run and extending generally longitudinally therefrom;

and a transverse run extending between said connector runs generally at the longitudinally opposite ends of said connector runs from said arcuate run, and comprising a laterally innermost deformable sealing portion integrally adjoining said connector runs, and a laterally outermost rigid support portion bonded to said sealing portion and extending, at least in part, laterally outwardly beyond said sealing portion.

40. The seal of claim 39 wherein said support portion at least partially longitudinally underlies said sealing portion of said transverse run.

41. The seal of claim 39 wherein said support portion of said transverse run comprises a metallic material.

42. Shear ram apparatus for severing and sealing a string of drill pipe comprising:

a housing body having a throughway for receipt of said drill pipe;

and opposed first and second ram assemblies mounted in said housing body on opposite sides of said throughway for reciprocation laterally inwardly and outwardly, each of said ram assemblies comprising a carrier connected to a drive means for effecting such reciprocation, and a ram block carried on the laterally inward side of said carrier;

said first ram assembly further comprising a blade member carried on its ram block;

said second ram assembly having, on its ram block, an anvil formation positioned for cooperation with said blade member to apply a shearing force to said drill pipe when said ram assemblies are moved laterally inwardly;

said carrier of said second ram assembly comprising a pair of arms partially peripherally surrounding said ram block generally on the outer side thereof, and the free ends of said arms having notches defining laterally inwardly facing backing surfaces;

in said second ram assembly, said ram block being connected to said carrier for limited relative lateral movement such that, upon movement of said second ram assembly laterally inwardly, and further upon arresting of such laterally inward movement of said ram block, said carrier may continue such laterally inward movement for a limited distance;

said second ram assembly further comprising second seal means cooperative between said ram block and said carrier for compressive actuation by such continued laterally inward movement of said carrier with respect to said ram block;

said ram block of said second ram assembly defining a recess opening laterally inwardly toward said throughway for receipt of said blade member when said ram assemblies are moved laterally inwardly;

said second seal means comprising a blade sealing element extending transversely across said carrier generally between the free ends of said arms and facing longitudinally into said recess for sealing against a longitudinally facing surface of said blade member;

and said second ram assembly further comprising a seal actuator element extending transversely across said carrier generally between the free ends of said arms, disposed in laterally outward backing relation to said blade sealing element, and mounted on said ram block for limited lateral movement with respect to said ram block, said actuator element having ends removably disposed in said notches with said backing surfaces in laterally outward backing relation to said actuator element, whereby, upon such continued laterally inward movement of said carrier with respect to said ram block, said actuator element is moved laterally inwardly with respect to said blade sealing element.

* * * * *